US012612556B2

(12) United States Patent
Goldschlager

(10) Patent No.: US 12,612,556 B2
(45) Date of Patent: Apr. 28, 2026

(54) PRODUCTION OF PRODUCTS FROM BIOMASS

(71) Applicant: HERMAL BIO ENERGY INTERNATIONAL PTY LTD, Beaumaris (AU)

(72) Inventor: Ronald David Goldschlager, Beaumaris (AU)

(73) Assignee: HERMAL BIO ENERGY INTERNATIONAL PTY LTD, Beaumaris (AU)

( * ) Notice: Subject to any disclaimer, the term of this patent is extended or adjusted under 35 U.S.C. 154(b) by 104 days.

(21) Appl. No.: 17/616,816

(22) PCT Filed: Jun. 8, 2020

(86) PCT No.: PCT/AU2020/050582

§ 371 (c)(1),
(2) Date: Dec. 6, 2021

(87) PCT Pub. No.: WO2020/243796

PCT Pub. Date: Dec. 10, 2020

(65) Prior Publication Data

US 2022/0306940 A1 Sep. 29, 2022

(30) Foreign Application Priority Data

Jun. 6, 2019 (AU) ..... 2019901956

(51) Int. Cl.

| | |
|---|---|
| ***C10B 53/02*** | (2006.01) |
| ***C10B 57/00*** | (2006.01) |
| ***C10B 57/16*** | (2006.01) |
| ***C10G 1/02*** | (2006.01) |
| ***C10G 2/00*** | (2006.01) |
| ***C10G 5/06*** | (2006.01) |

(52) U.S. Cl.
CPC ..... *C10B 53/02* (2013.01); *C10B 57/005* (2013.01); *C10B 57/16* (2013.01); *C10G 1/02* (2013.01);
(Continued)

(58) Field of Classification Search
CPC ..... C10B 53/02; C10B 57/005; C10B 57/10; C10B 57/16; C10G 1/002; C10G 1/02;
(Continued)

(56) References Cited

U.S. PATENT DOCUMENTS 4,678,860 A 7/1987 Kuester
8,043,391 B2 10/2011 Dinjus et al.
(Continued)

FOREIGN PATENT DOCUMENTS

GB 2037809 B 7/1980
WO 2012039878 A1 3/2012
WO 2020093110 A1 5/2020

OTHER PUBLICATIONS

Najjar, Yousef S.H., "Gas turbine cogeneration systems: a review of some novel cycles", Applied Thermal Engineering, 20(2000), pp. 179-197. (Year: 2000).*
Australian Patent Office, "International Search Report for PCT Application No. PCT/AU2020/050582", Australia, Aug. 13, 2020.
European Patent Office, European Search Report for EP Application No. 20818830, Europe, Jun. 15, 2023.

*Primary Examiner* — Renee Robinson
(74) *Attorney, Agent, or Firm* — Troutman Pepper Locke LLP; Tim Tingkang Xia, Esq.

(57) ABSTRACT

A process for producing products from biomass comprises pyrolysing biomass at a selected temperature and producing a bio-syngas, processing bio-syngas from pyrolysis step (a) to remove condensable constituents from the bio-syngas, and processing the non-condensable bio-syngas from bio-syngas processing step (b) and producing one or more than one product, such as bio-fuels, bio-chemicals, bio-solvents and bio-plastics.

16 Claims, 5 Drawing Sheets

(51) Int. Cl.

| | |
|---|---|
| ***C10K 1/00*** | (2006.01) |
| ***C10K 1/04*** | (2006.01) |
| ***C10K 3/06*** | (2006.01) |
| *C10B 57/10* | (2006.01) |

(52) U.S. Cl.
CPC ..... *C10G 2/32* (2013.01); *C10G 5/06* (2013.01); *C10K 1/001* (2013.01); *C10K 1/046* (2013.01); *C10K 3/06* (2013.01); *C10B 57/10* (2013.01); *C10G 2300/1011* (2013.01)

(58) Field of Classification Search
CPC . C10G 2/32; C10G 5/06; C10K 1/001; C10K 1/046
See application file for complete search history.

(56) References Cited

U.S. PATENT DOCUMENTS

| | | | | |
|---|---|---|---|---|
| 2010/0275514 | A1* | 11/2010 | Paganessi | C10J 3/08 48/209 |
| 2012/0063965 | A1* | 3/2012 | Coates | B08B 9/0436 422/164 |
| 2012/0067773 | A1* | 3/2012 | Ditsch | C10G 2/30 208/51 |
| 2013/0199919 | A1* | 8/2013 | Li | C10B 47/30 201/7 |
| 2013/0327627 | A1 | 12/2013 | Daugaard et al. | |
| 2016/0032196 | A1 | 2/2016 | Abdullah et al. | |
| 2019/0153324 | A1 | 5/2019 | Urade et al. | |

* cited by examiner

PRODUCTION OF PRODUCTS FROM BIOMASS

TECHNICAL FIELD

The present invention relates to a process for producing solid, liquid or gas products that are suitable for use as bioenergy (such as a fuel) or chemicals production from biomass and other sources of bioenergy, including but not limited to wood waste biomass.

BACKGROUND ART

Currently, the forestry industry generates considerable amounts of low-economic value "waste" biomass, such as sawdust, woodchips, wood shavings, and chipper fines. The biomass is a source of bioenergy.

Typically, 40% to 60% of the input log wood fibre to sawmills becomes waste biomass in the form of sawdust, woodchips, wood shavings and off-cuts.

Typically, 25% to 40% of timber from plantation and native forests becomes waste biomass.

Typically, 3% to 5% of the input log wood fibre to chipping mills becomes waste biomass.

Other than waste biomass which is used for on-site thermal energy generation, none of the energy stored in the above-described waste biomass is utilised beneficially.

There are other sources of biomass that are under-utilised and have stored energy that is not used beneficially.

The above description is not an admission of the common general knowledge in Australia or elsewhere.

SUMMARY OF THE DISCLOSURE

Australian provisional patent application 2018904255 lodged on 8 Nov. 2018 in the name of the applicant describes a process for producing a paste product that is suitable for use as a fuel or for chemicals production from a source of bioenergy that comprises the following steps:

(a) pyrolysing a feed material in the form of a wood waste biomass and/or other biomass and/or other sources of bioenergy at a selected temperature under pyrolysis conditions in a closed system that avoids forming light fractions and decomposing the feed material and producing a solid char and a bio-syngas (referred to as a bio-syngas in the context of the subject invention), (b) producing bio-liquids (such as bio-tars) and bio-syngas from the biogas from pyrolysis step (a); and (c) mixing char and bio-liquids (such as bio-tars) and water and forming a paste product.

The disclosure in Australian provisional application 2018904255 is incorporated herein by cross-reference.

The applicant has realised that there are advantages in modifying the process described in Australian provisional application 2018904255 to focus on the production of bio-syngas from the output of pyrolysis step (a) and thereafter on the use of the biogas for the production of products, such as bioenergy (such as bio-fuels), bio-chemicals, bio-solvents and bio-plastics, rather than on the focus of the process described in Australian provisional application 2018904255 on the production of a paste product that can be used as an energy source.

In the circumstances, the invention provides in general terms a process for producing products from biomass that comprises pyrolysing biomass at a selected temperature (or within a selected temperature range) and producing a bio-syngas, processing bio-syngas from pyrolysis step (a) to remove condensable constituents from the bio-syngas, and processing the non-condensable bio-syngas from bio-syngas processing step (b) and producing one or more than one product, such as bio-fuels, bio-chemicals, bio-solvents and bio-plastics.

In more specific terms, the invention provides a process for producing more than one product, such as bio-fuels, bio-chemicals, bio-solvents and bio-plastics, from biomass or other sources of bioenergy that comprises the following steps:

(a) pyrolysing a feed material in the form of a wood waste biomass and/or other biomass and/or other sources of bioenergy at a selected temperature (or within a selected temperature range) and decomposing the feed material and producing a bio-syngas (which can also be described as biogas), (b) processing bio-syngas from pyrolysis step (a) to remove condensable constituents from the bio-syngas and producing (i) a condensed bio-liquid, such as a bio-tar, and (ii) a non-condensable bio-syngas; and (c) processing the non-condensable bio-syngas from bio-syngas processing step (b) in a bio-hydrocarbons synthesis process step and producing one or more than one product, such as bio-fuels, bio-chemicals, bio-solvents and bio-plastics.

As noted above, the products produced in the bio-hydrocarbons synthesis process step may include bioenergy (such as bio-fuels), bio-chemicals, bio-solvents and bio-plastics.

The operating conditions for the pyrolysis step (a), the bio-syngas processing step (b), and the bio-hydrocarbons synthesis process step will be selected based on the products that are required.

The process of the invention is preferably focused on maximising production and recovery of bio-syngas from the pyrolysis step (a).

Specifically, typically the operating conditions for the pyrolysis step (a) are selected so that at least 80%, typically at least 85%, typically at least 90%, of the output of the pyrolysis step (a) on a wt. % basis is bio-syngas.

The process of the invention also preferably focused on maximising production and recovery of separate process streams from the bio-syngas from the pyrolysis step (a), with one process stream being condensable constituents that form bio-liquids (condensates, such as bio-tars) and the other process stream being non-condensable bio-syngas.

It is noted that the term "non-condensable" is understood to mean at least substantially non-condensable in that the term extends to compositions that have small amounts of gases that can be said to be condensable.

There are many possible uses for the bio-syngas.

One use is as a bio-fuel for engines.

Another possible use is for bio-chemicals, bio-plastic, and bio-solvent production.

Engine manufacturers do not want "ash" in fuel, as it fouls the cylinders. There are small quantities of inorganics in biomass. Mainly potassium, with some sodium and small amounts of silica and chlorine. These inorganics tend to concentrate in the solid phase produced in the pyrolysis step (a) and are not present in the gas phase produced in the pyrolysis step. This is an advantage. Moreover, higher temperatures for the pyrolysis step (a) reduce the amount of ash in the gas phase. In addition, to the extent that there is ash in the gas phase, this can be removed via scrubbing or other process options.

The process may produce char (solid phase) in the pyrolysis step (a).

The process may include recovering energy/heat from the char and using the energy/heat within the process, thus avoiding the inorganics being present in the bio-syngas and downstream products of the process.

The energy/heat may be used outside the process.

Typically, engine manufacturers also do not want much (if any) $H_2$ in the bio-syngas. Therefore, for this application, the process may include selecting operating conditions for the pyrolysis step (a) to minimise the amount of $H_2$ in the bio-syngas.

For other applications, higher amounts of $H_2$ in the bio-syngas may be preferred. For example, the applicant has found that 15-18% $H_2$ in the bio-syngas is preferred in some applications, including engine applications.

The invention is not confined to these amounts of $H_2$ (or other amounts of typical bio-syngas constituents) in the bio-syngas from the pyrolysis step (a), and the invention extends to higher amounts of Hz.

It is noted as a general comment that the process of the invention makes it possible to produce wide ranges of each of the constituents in the bio-syngas composition from the pyrolysis step (a), and the above reference to $H_2$ is one example of this flexibility of the invention. The same comment applies to other typical constituents, such as CO, $CO_2$, and $CH_4$.

Engine manufacturers also prefer a maximum engine feed temperature of 50-60° C. for bio-syngas.

As the bio-syngas will exit the pyrolysis step (a) at much higher temperatures than the typical maximum feed temperature of 50-60° C., the process may include a cooling step for bio-syngas when an immediate end use of bio-syngas is for use as an engine fuel.

The cooling step may include a gas storage (buffer) step.

The gas storage (cooling) step may enable some condensation of bio-liquids to occur, and this the process may include collecting condensed liquids form the bio-syngas.

The system energy equation for the invention may be described as follows:

Per tonne of wet biomass input to the process, the process releases close to 2 MWe (heat energy), of which:

(a) about ⅓ is required to power the system, (b) ⅓ is available for electricity generation, and (c) ⅓ is available as heat energy (e.g. for kiln drying timber or other industrial process needs).

The bio-syngas processing step (b) may include cooling the condensable bio-syngas depending on the requirements for the downstream use of the bio-syngas.

It is noted that the invention extends to situations where it is not necessary to cool the condensable bio-syngas at all, such as for combustion in boilers and other applications where hot gases are acceptable (and preferred).

Typically, the bio-hydrocarbons synthesis process step (c) produces $O_2$.

The process may include transferring $O_2$ from the bio-hydrocarbons synthesis process step (c) to the pyrolysis step (a) to substitute at least a part of the air that would otherwise be needed for combustion of an energy source to provide heat for the pyrolysis step (a) (thus, eliminating or minimising $N_2$). As a consequence, it is possible to produce bio-syngas that is at least substantially nitrogen free.

The process may include enriching the bio-syngas by "cracking" bio-liquids produced in the process, thereby enriching bio-syngas with more hydrocarbons such as $CH_4$, $C_2H_4$ and $C_2H_6$.

The $CO_2$ emissions may be food grade $CO_2$. Thus, treating exit gas from the process via membrane separation or other suitable separation technology, it is possible to remove/recover $CO_2$ (further reducing the greenhouse gases) and recovering $CO_2$ for commercial use (liquid $CO_2$), for example for the beverage industry.

The process may include breaking down longer/larger hydrocarbon molecules of the bio-liquids into bio-gases, this enriching the bio-gas, for example via a catalytic cracker unit.

The process may include mixing (i) char from the pyrolysis step (a), (ii) bio-liquids from the bio-syngas processing step (b) and optionally (iii) water and forming a paste product (or other suitable combustible product).

The process may include grinding char to a required particle size for the paste product (or other suitable combustible product).

The process may include selecting the operating conditions in the pyrolysis step (a) to maximise production of bio-syngas compared to other pyrolysis products produced in the pyrolysis step (a).

The selection of the temperature for the pyrolysis step (a) is one relevant operating condition.

Other relevant operating conditions include the properties of the feed material and the residence time in the pyrolysis step (a).

The selected temperature for the pyrolysis step (a) may be a low temperature of ≤500° C., typically greater than 300° C., and typically 300-500° C.

The selected temperature for the pyrolysis step (a) may also be a higher temperature of >500° C. As noted above, the focus of the invention is to operate at higher temperatures to optimize production of bio-syngas in the pyrolysis step (a).

The pyrolysis step (a) may be a "slow pyrolysis" step or a "fast pyrolysis" step.

The bio-syngas processing step (b) may include condensing bio-liquids from the bio-syngas from the pyrolysis step (a).

The bio-syngas may include hydrocarbons, such as $CH_4$, $C_2H_4$, and $C_2H_6$.

The bio-syngas may include 6~7 MJ/kg of bio-syngas.

The process may include a drying step of drying the feed material to the pyrolysis step (a) to a required moisture content for the pyrolysis step (a).

The process may include condensing moisture released in the drying step and using the condensed water in other applications.

For example, the process may include using the condensed water to form the paste product and/or for other process requirements.

By way of further example, the condensed water may be used as drinking water.

The invention also includes a bio-fuel produced by the above-described process.

The bio-fuel may include at least 15, typically at least 20, MJ/kg of the bio-fuel.

The invention also includes a paste product produced by the above-described process.

The paste product may include at least 20, typically at least 25 Mj/kg of the paste product.

The paste product may include at least 15, typically at least 18 Mj/kg of the paste product.

The paste product may include a solids concentration of at least 5, typically 5-10% char.

The invention also provides a plant for producing products, such as bio-fuels, bio-chemicals, bio-solvents and bio-plastics, from biomass or another source of bioenergy that includes:

(a) a pyrolyser unit for pyrolysing a feed material in the form of a wood waste biomass and/or other biomass and/or other sources of bioenergy at a selected temperature and decomposing the feed material and producing a bio-syngas, (b) a bio-syngas condenser for condensing bio-liquids (such as bio-tars) from the bio-syngas from the pyrolysis unit and producing (i) condensed bio-liquids and (ii) a non-condensable bio-syngas; and (c) a bio-hydrocarbon synthesis unit for producing one or more than one product from the bio-syngas.

As noted above, the products produced in the bio-hydrocarbon synthesis unit may include bio-fuels, bio-chemicals, bio-solvents and bio-plastics.

The pyrolyser unit may also produce a solid char.

The pyrolyser unit may include a combustion unit for generating heat for pyrolysing the feed material.

The combustion unit may be adapted to operate with air, $O_2$ or $O_2$-enriched air.

The bio-hydrocarbon synthesis unit may be configured to produce 02.

The production plant may be configured to transfer $O_2$ produced in the bio-hydrocarbon synthesis unit to the combustion unit.

The selected temperature for the pyrolyser unit may be a low temperature of ≤500° C., typically greater than 300° C., and typically 300-500° C.

The selected temperature for the pyrolyser unit may also be a higher temperature of >500° C., typically >600° C.

The production plant may include a dryer unit for drying the feed material before the feed material is transferred to the pyrolysis unit.

The dryer unit may be adapted to produce a moisture-containing gas that is discharged from the dryer unit.

The dryer unit may include a condenser unit for condensing water from the moisture-containing gas.

The production plant may be located in any suitable location.

The production plant may include a paste product unit for producing the paste product from char from the pyrolyser unit, bio-liquids (such as bio-tars) from the bio-syngas condenser, and optionally water.

The production plant may be configured to transfer condensed water from the condenser of the dryer unit to the paste product unit to facilitate paste production.

The production plant may be advantageously located close to a sustainable source of biomass, such as a plantation and/or a sawmill, and thereby make it possible to avoid significant transport costs associated with the removal of wood waste biomass from sawmills as well as reduced emissions from transporting wood waste biomass to a production plant at a remote location for the biomass source.

The term "biomass" is understood herein to mean living or recently living organic matter. Specific biomass includes, by way of example, the above-described forestry industry products, agricultural products, biomass produced in aquatic environments such as algae, agricultural residues such as straw and other crop stubble and chaff, olive pits, and agricultural hemp and marijuana plant production waste and nut shells, animal wastes, municipal and industrial residues.

The feed material for the pyrolysis step (a) may be any suitable material. For example, the feed material may be (a) agricultural waste such as crop waste and/or (b) wood waste biomass from any one or more than one of harvesting operations in plantation and native forests, chipping operations, sawmilling operations, and sustainable wood products manufacturing operations.

In addition, by way of example, the feed material may be higher quality biomass rather that biomass sourced as waste products.

The term "pyrolysis" is understood herein to mean thermal decomposition of organic material in the absence of or with limited supply of an oxidising agent, such as air or oxygen-enriched air. This could range from "mild pyrolysis" leading to drying and partial thermal decomposition, to "full pyrolysis" resulting in oil, gas and char products. The main products of pyrolysis are gases, liquids, and char. Typically, the gases include water vapor, carbon monoxide, carbon dioxide, hydrogen, and hydrocarbons. Typically, the liquids include water, tars, and oils. Lower processing temperatures and longer vapor residence times favor the production of char—such processing is often referred to as "slow pyrolysis". Moderate temperatures and short vapor residence times favor the production of liquids—such processing is often referred to as "fast pyrolysis".

The term "slow pyrolysis" is understood herein to mean pyrolysis with a residence time that is typically at least one minute.

The term "fast pyrolysis" is understood herein to mean pyrolysis with a residence time that is typically less than a minute.

The term "bio-char" is understood herein to include char products formed via decomposition of feed material and products made by processing biochar, such as activated carbon.

The term "bio-syngas" is understood herein to mean a gas that is produced from the breakdown of organic material. Typically, bio-syngas contains $CO_2$, $H_2$, and $CH_4$. Typically, bio-syngas contains significant amounts of $CH_4$. In the context of the invention, typically bio-syngas contains 50 to 70 vol. % $CH_4$, up to 25 vol. % Hz, and up to 30 vol. % $CO_2$. The bio-syngas may include other hydrocarbons, such as $C_2H_4$ and $C_2H_6$. The bio-syngas may include CO.

The term "food grade" is understood herein to mean suitable for use in the food industry. For example, "food grade" includes tools, supplies, and equipment that are of sufficient quality to be used for food production, food storage, or food preparation purposes.

The term "paste" is understood herein to mean a mixture of bio-liquid and char and, optionally, water.

Typically, the term "paste" includes a mixture of bio-liquid, char and water produced from the pyrolysis process itself.

The invention is based on the use of a fast pyrolysis closed system and on forming the paste product from the outputs of the pyrolysis step.

The invention also extends to situations in which the bio-syngas produced in the pyrolysis step is used directly, i.e. without separating bio-syngas from the pyrolysis step into condensable and non-condensable constituent streams, in downstream applications, for example as an energy source for a burner, such as a steam boiler. In this context, it is preferred that the operating conditions, such as temperature and residence time, for the pyrolysis step be selected to optimize the required gas composition for the direct end-use application.

Therefore, the invention provides a process for producing products from biomass that comprises pyrolysing biomass at a selected temperature (or within a selected temperature range) and producing a bio-syngas, with the pyrolysis step including selecting pyrolysis operating conditions, such as temperature and residence time, to optimize the required gas composition for a direct end-use application for the bio-syngas.

Features of the invention include the following features, by way of example:

- A self-sustaining thermochemical process for converting biomass to bioenergy, such as a bio-fuel for producing work/power.
- A self-sustaining thermochemical process for converting biomass to other products, such as bio-chemicals, bio-solvents and bio-plastics.
- The bio-syngas produced from bio-syngas from the pyrolyser unit can be converted to products, including bio-chemicals, bioenergy (such as bio-fuels), bio-solvents and bio-plastics, via the bio-hydrocarbons synthesis unit (such as a Fischer Tropsch or other process unit).
- The process makes it possible to produce bio-fuels with very low concentrations of inorganics and other pollutants, thereby making the bio-fuels suitable for use as a fuel source for engines.
- The potential to produce $O_2$ in the bio-hydrocarbons synthesis unit (such as a Fischer Tropsch or other process unit) and to use the $O_2$ as an oxidant in the combustion unit of the pyrolyser unit—thereby allowing substitution of air with $O_2$.
- Oxygen substitution for air described in the preceding dot point provides higher/improved efficiencies in the combustion process.
- In addition, the oxygen substitution for air avoids nitrogen in air, so that the bio-syngas produced from bio-syngas from the pyrolyser is nitrogen-free or has lower nitrogen concentrations than would otherwise be the case, and this avoids/reduces the need/cost of separating nitrogen from the bio-syngas.
- The condensed water from the drying step is a source of clean water that has many potential uses.
- For example, condensed water from the drying step can be used as make-up water for mixing with char+bio-liquids (such as bio-tars) to produce a paste product if this is required.
- The potential for production of useful work/power from combustion of the paste product in a combustor or a modified internal combustion engine.
- Mixing condensed bio-liquids (such as bio-tars) produced from bio-syngas from the pyrolysis step with char from the pyrolysis step (a) to maximize the heating value of the paste product for subsequent combustion in a combustor or a modified internal combustion engine.
- Further to the previous dot point, hot flue gas from the combustor or a modified internal combustion engine can be used within the dryer system—to maximize process efficiency.
- Further to the previous dot point, cooled flue gas from the combustor can be used within the dryer to maximize process efficiency—heat recovery.
- A portion of the char from the pyrolysis step (a) can be combusted to generate heat to keep the pyrolysis step as a self-sustaining step.

DESCRIPTION OF FIGURES

The invention is described further by way of example only with reference to the accompanying Figures, of which.

DESCRIPTION OF EMBODIMENTS

Figure 1:
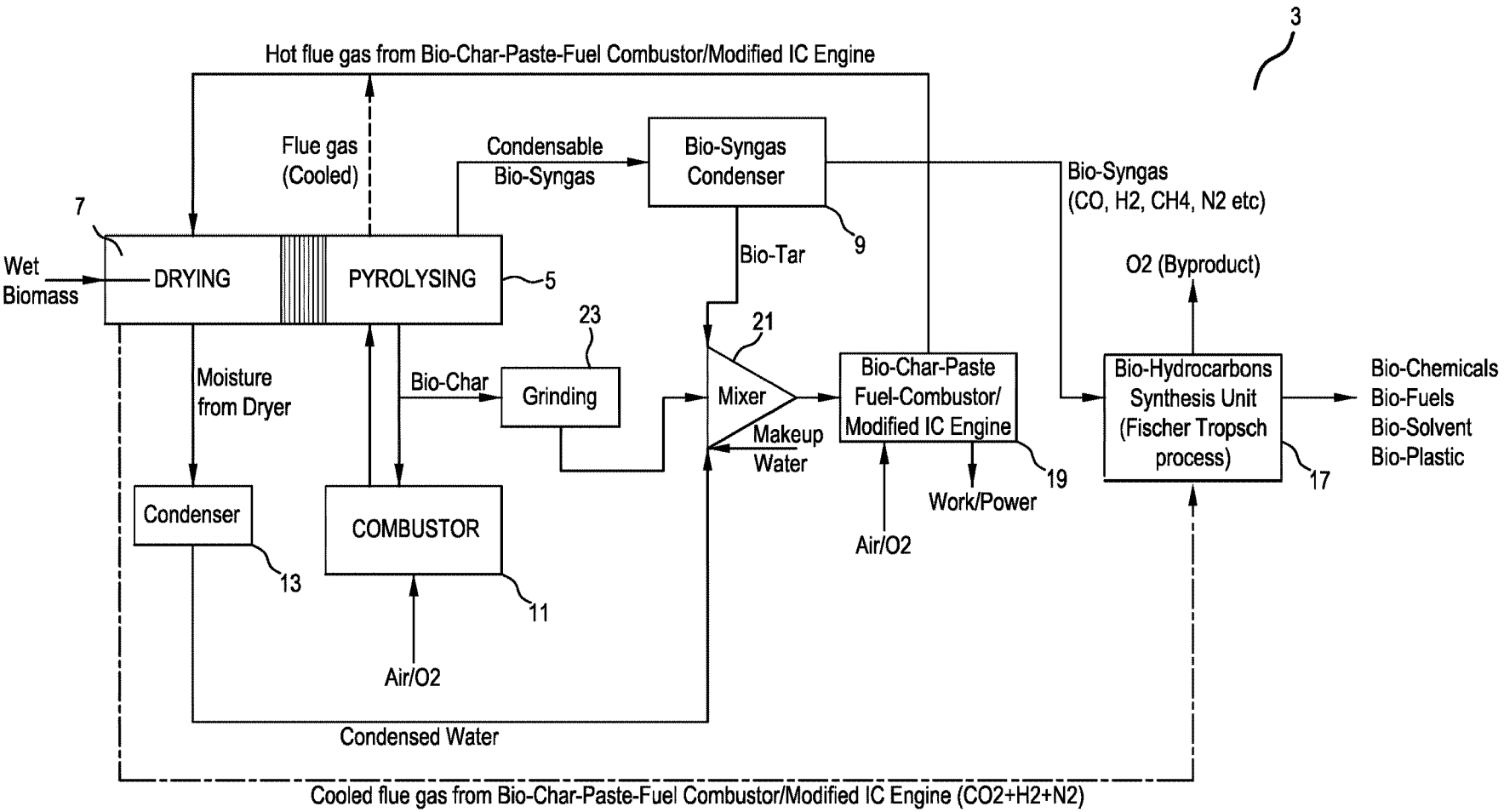
FIG. 1 is a flow sheet that summarises an embodiment of the process and production plant of the present invention.

The following description of embodiments of the invention is divided into the following sections:

FIG. 1 embodiment (including a series of sub-headings).

Summary of experimental work.

FIG. 5 embodiment.

FIG. 6 embodiment.

FIG. 1 Embodiment

An embodiment of the process and the production plant 3 of the present invention is described with reference to the flowsheet of FIG. 1.

The process shown in the flowsheet of FIG. 1 produces products, such as bio-fuels, bio-chemicals, bio-solvents and bio-plastics from a source of bioenergy that includes biomass from wood waste or other sources of biomass. The process comprises the following steps:

(a) drying a feed material in the form of a wood waste biomass and/or other biomass in a drying unit 7 to a suitable moisture content for a pyrolysis step in the process and producing (i) dried feed material (compared to the input feed material—typically 10-15% moisture) and (ii) water;

(b) pyrolysing the dried feed material at a selected temperature, such as but not necessarily at a low temperature of <500° C., typically 300-500° C., and typically at higher temperatures of >500° C., more typically >550° C., typically under fast pyrolysis (flash pyrolysis) conditions in a closed system pyrolyser unit 5 that avoids forming or minimises forming light fractions and decomposing the feed material and producing (i) a solid char output and (ii) a bio-syngas output, (c) processing bio-syngas from pyrolysis step (a) in a bio-syngas condenser unit 9 and producing (i) non-condensable bio-syngas (typically CO, $H_2$, $N_2$, and $CH_4$ and other hydrocarbons, such as $C_2H_4$ and $C_2H_6$) and (ii) condensed constituents of the bio-syngas as bio-liquids (referred to as bio-tar in the Figure);

(d) processing non-condensable bio-syngas from the bio-syngas condenser unit 9 and producing products, such as bioenergy (referred to as bio-fuels in the Figure), bio-chemicals, bio-solvents and bio-plastics from bio-syngas processing step (b), for example by processing the bio-syngas in a bio-hydrocarbons synthesis unit 17, such as a Fischer Tropsch or other process unit, for example catalyst-based units; and (e) processing bio-tar from the condenser 9 and producing products that can be used as sources of energy.

The key focus of the process of the embodiment is to maximise the production of bio-syngas (typically CO, $CO_2$, $H_2$, $N_2$, and $CH_4$ and other hydrocarbons, such as $C_2H_4$ and $C_2H_6$) from biomass in the pyrolysis step and to process bio-syngas by removing condensable constituents and producing bio-syngas that is processed further as required to suit selected end-use applications to form products, such as bio-chemicals, bio-fuels, bio-solvents, and bio-plastics. Having said this, the embodiment also makes use beneficially of the char produced in the pyrolyser unit 5 and the bio-liquids produced in the bio-syngas condenser unit 9.

Specifically, typically the operating conditions for the pyrolysis step (a) are selected so that at least 80 wt. %, typically at least 85 wt. %, typically at least 90 wt. %, of the output of the pyrolysis step (a) is bio-syngas.

The selection of the temperature for the pyrolysis step (a) is one relevant operating condition. Typically, higher temperatures of >500° C., more typically >550° C., and more typically again >600° C. are required to increase the bio-syngas output for the pyrolysis step (a).

Other relevant operating conditions include, by way of non-limiting example, the properties of the feed material and residence time in pyrolysis step (a).

The process makes it possible to produce bio-chemicals, bioenergy (such as bio-fuels), bio-solvents, and bio-plastics with very low concentrations of inorganics.

In the case of bio-fuels, this means that the bio-fuels are suitable for use as a fuel source for engines.

More particularly, the process includes the following steps:

(a) grinding a part of the char output from the pyrolyser unit 5 in a suitable mill (not shown);

(b) processing bio-syngas from the pyrolysis step by condensing condensable constituents in the bio-syngas condenser unit 9 and producing a bio-liquid and a non-condensable bio-syngas; and (c) mixing the ground char from the pyrolysis step, the bio-liquid from the bio-syngas processing step, and optionally water in a mixing unit and forming a paste product in a paste product mixing unit 21.

The moisture released in the drying unit 7 is transferred to a condenser unit 13 and the liquid water from the condenser unit 13 is transferred to and used as at least part of the water input to the paste product mixing unit 21.

A part of the char output from the pyrolyser unit 5 is combusted in a combustion unit 11 and the output heated combustion gases are used to provide heat for the pyrolyser unit 5 via indirect heat exchange.

The flowsheet also shows examples of possible downstream uses of the paste product from the paste product mixing unit 21 and the bio-syngas produced in the bio-syngas condenser unit 9. These downstream uses include:

(a) using the paste product as a source of energy in a combustion unit 19 or a modified internal combustion engine; and (b) using the bio-syngas from the bio-syngas condenser unit 9 in bio-chemicals production, specifically a bio-hydrocarbons synthesis unit 17, such as a Fischer Tropsch or other process unit, and producing (i) bio-chemicals, bio-fuels, bio-solvents, and bio-plastics and (ii) $O_2$, with the $O_2$ being beneficially used in the plant.

Features of the embodiment shown in the flowsheet of FIG. 1 are as follows:

Water evaporated from the dryer unit 7 is used in the process for higher efficiency and/or in downstream processes.

Gas from the combustion unit 11 or a modified internal combustion engine 19 can be used within the process—specifically, in the dryer unit 7 for higher efficiency.

Cooled heating gas (from the pyrolyser unit 5) can be used within the process—specifically, in the dryer for higher efficiency.

The pyrolyser unit 5 is indirectly heated.

The $O_2$ by-product from the Fischer Tropsch or other suitable process unit 17 can be used as an oxidant for the combustion unit for the indirectly heated pyrolyser unit 5. As noted above, this use of oxygen as a substitute for air is beneficial for the process.

The dryer/pyrolysis unit combination 5, 7 can easily be controlled to vary moisture content during pyrolysis. This provides unique control of composition of exit gases. (i.e. "bio-syngas"—the CO and $H_2$ ratios, etc.).

Products of the pyrolysis unit include:

Solid (char).

Liquid (pyrolysis hydrocarbons).

Gas (bio-syngas).

Initial calculations are that the usable, high grade energy produced is about 1.5 MWt per tonne of wood waste biomass.

The char may have some "activated carbon" properties, excellent for use in catalysis.

Biomass

The elemental composition of wood waste biomass and other types of biomass differs based on where these species are grown.

Compared to other solid fuels such as coal, wood waste biomass has higher volatile and oxygen content, but low heating value and fixed carbon content.

Additionally, the sulphur content in wood waste biomass is small, mostly less than 0.5 wt. %. In addition, typically the inorganics in wood waste biomass are also generally very low.

The main components of wood waste biomass are cellulose, hemicellulose, and lignin, each of which is different in their decomposition behavior.

The decomposition of each element occurs in a different temperature range and depends on heating rate, particle size and presence of the contaminants. Hemicellulose is the easiest one to be pyrolyzed, next would be cellulose, while lignin is the most difficult one.

Products of Biomass Pyrolysis

The two primary products obtained from pyrolysis of wood waste biomass and other types of biomass in the embodiment of FIG. 1 are solid char and bio-syngas. The bio-syngas is condensed to remove condensable constituents as a dark brown viscous bio-tar, leaving a non-condensable bio-syngas. The condensed bio-tar is a useful source of energy.

Char

Thermal degradation of lignin and hemicellulose in wood waste biomass in the embodiment of FIG. 1 results in a considerable mass loss in the form of volatiles, leaving behind an amorphous carbon matrix which is referred to as bio-char.

Depending on the biomass and the pyrolysis conditions in the pyrolysis unit 5, 10 to 35% biochar is produced.

It has been reported in the technical literature that three different temperature regions produce different char yields during pyrolysis, as follows:

450-500° C. (Low-temperature zone): char quantity was high due to low devolatilization rates and low carbon conversion.

550-650° C. (Moderate-temperature zone): char reduced dramatically. The maximum yield in this region was found to be about 8 to 10% of biochar >650° C. (High-temperature zone): char yield was very low.

The properties of char depend on pyrolysis as well as feedstock conditions.

Generally, the following characteristics can be observed during biochar production:

1. Char physical characteristics are much affected by pyrolysis conditions such as reactor type and shape, biomass type and drying treatment, feedstock particle size, chemical activation, heating rate, residence time, pressure, the flow rate of inert gas, etc.
   - Pyrolysis operating conditions such as higher heating rate (up to 105-500° C./s), shorter residence time and finer feedstock produce finer char whereas slow pyrolysis with larger feedstock particle size results in a coarser char.
   - Crop residues and manures generate a finer and more brittle structured char in pyrolysis processes.
2. Char mainly consists of carbon along with hydrogen and various inorganic species in two structures: stacked crystalline graphene sheets and randomly ordered amorphous aromatic structures. The C, H, N, O and S are commonly combined as heteroatoms that influence the physical and chemical properties of biochar. However, composition, distribution and proportion of these molecules in biochar depend on a variety of factors including source materials and the pyrolysis methodology used.

Bio-Syngas

Temperature and moisture content affect the bio-syngas production in the pyrolysis unit 5 through heat transfer processes.

Bio-syngas produced in the pyrolysis unit 5 comprises $H_2$, CO, $CH_4$, $CO_2$, water vapour ($H_2O$), nitrogen ($N_2$) and light hydrocarbons such as $C_2H_4$ and $C_2H_6$.

The amount and the composition of the bio-syngas (and the amount of char) produced in the pyrolysis step 5 is a function of pyrolysis conditions, such as temperature and residence time.

Bio-Liquids, Such as Bio-Tar

Bio-liquids, such as bio-tar produced from the condensation of bio-syngas from the pyrolyser unit 5, have the following advantages:

Bio-liquids, such as bio-tar, are transportable.

A high energy density—a useful source of energy.

Biomass Pyrolysis Units 5

The pyrolysis unit 5 options include, by way of example only: Bubbling fluidized bed.

Fixed bed reactor.

Circulating fluidized bed.

Ablative reactor.

Rotating cone reactor.

PyRos reactor.

Auger reactor.

The above embodiment is an effective and efficient embodiment of maximizing energy recovery from biomass.

Summary of Experimental Work

Extensive test work in relation to the invention has been carried out in the Chemical Engineering Department of Monash University, Melbourne, Victoria, for the applicant.

The test work included but was not limited to the experimental work summarized below:

Flash and slow pyrolysis of biomass under an inert environment was conducted in a bespoke pyrolysis unit operating either as a fixed bed reactor or as a fluidised bed reactor depending on the particle size of biomass supplied to the pyrolysis unit.

The size of the biomass particles was in a range of 200 μm to 2 mm.

Pyrolysis temperatures were in a range of 400° C.-600° C. and pyrolysis was carried out at atmospheric pressure.

The gas residence time inside the main vessel varied from 2-10 seconds depending on the operation mode and operating conditions (i.e. temperature and residence time).

The feed biomass was dried to 10-15% moisture before being supplied to the pyrolysis unit.

The feed rate of biomass to the pyrolysis unit was 30-50 g/min.

Three types of pyrolysis products, namely bio-syngas, solid char, and bio-liquid were collected and analysed for composition and other characteristics.

Pollutants emission analysis was also performed.

Pyrolysis Unit

The pyrolysis unit comprises (a) an electrically heated furnace, (b) a main vessel positioned within the furnace a feed assembly and having a reactor chamber for up to 5 kg of dry biomass (during batch operation), and (c) a separate condenser unit (including a chiller) for condensing and collecting liquid from bio-syngas discharged from the reactor chamber.

The pyrolysis unit includes a temperature controller for controlling the temperature in the reactor chamber.

The pyrolysis unit has a programmable control system. The unit can be operated either in batch mode or continuous operation mode.

As noted above, the pyrolysis unit can be operated as a fixed bed or a fluidised bed.

The electrically heated furnace is capable of heating the reactor chamber to temperatures in a range of 200-800° C.

The biomass residence time inside the main vessel was varied from 2-10 seconds depending on the operation mode and operating conditions.

The feed system is designed with screw feeder system. The feeding rate was varied between 1 kg~3 kg/hr (i.e. 17 g/min-50 g/min).

The chiller is capable of reducing the condenser temperature from 0-20° C. depending on the operation mode and operating conditions The pyrolysis unit is integrated with a micro-gas chromatograph that monitored the bio-syngas composition in real time.

Biomass

The biomass was E. Eucalyptus nitens. The biomass was wet (around 70-80% moisture). The biomass was air dried and ground to a particle size range of 200 μm to 2 mm, Normally, grinding biomass to a size less than 2 mm is too energy intensive.

Flash Pyrolysis Mode of Operation

In flash pyrolysis mode of operation, biomass was fed directly to the pre-heated reactor chamber.

During the experiments, the reactor chamber was preheated to 400° C. 500° C. or 600° C. Biomass was fed inside the reactor at 1 to 3 kg/hr (17-50 g/min). If the temperature remained constant, the gas composition, solid char, and liquid yields did not vary with feed rate. All the experiments were conducted at atmospheric pressure under inert atmosphere, with nitrogen being used as the inert gas. After each experiment, the amount of solid char inside the reactor chamber was measured. The bio-syngas released for the reactor chamber was calculated form the feed rate and other measurements.

Slow Pyrolysis Mode of Operation

In slow pyrolysis mode of operation, the reactor chamber was operated in a batch mode program. 3 kg d biomass (10% moisture) was supplied to the reactor chamber. The temperature of the reactor chamber heated to 400° C., 500° C. and 600° C. at a constant heating rate of 5° K/min. Nitrogen was used as inert gas for mass balance purposes. A trace gas is needed to do a proper mass balance, Nitrogen was used as the trace gas because it does not contribute to any reactions during pyrolysis. The nitrogen flow rate and the bio-oil collection rate are known. Integrating the measured flow data (mole fraction of gases from a micro GC) over the experimental time gives the total yield of bio-oil and bio-syngas. The sum of total yield of bio-oil, bio-syngas and solid char inside the reactor chamber makes total 3 kg of dry biomass). The nitrogen flow is calculated so that both in batch and continuous process, the gas residence time remains the same inside the reactor chamber.

Operating Procedure

The standard operating procedure was almost same for batch and continuous experiments.

- Wet biomass is dried until (10-15% moisture) and ground to a desired particle size and loaded to the feeder unit (for continuous operation) or directly into the reactor chamber (for batch operation).
- The reactor chamber was pre heated to the desired temperature (for continuous operation) or heated at a controlled rate from room temperature to the desired temperature (for batch operation).
- Purge nitrogen gas was used only for batch process.
- 17~50 g/min of biomass was fed (for continuous operation).
- The condenser was chilled to 10° C. for bio-oil condensation and collection form the bio-syngas from the pyrolysis unit.
- Char residue was collected from the reactor chamber after each experiment.

Analytical Equipment

Figure 2:
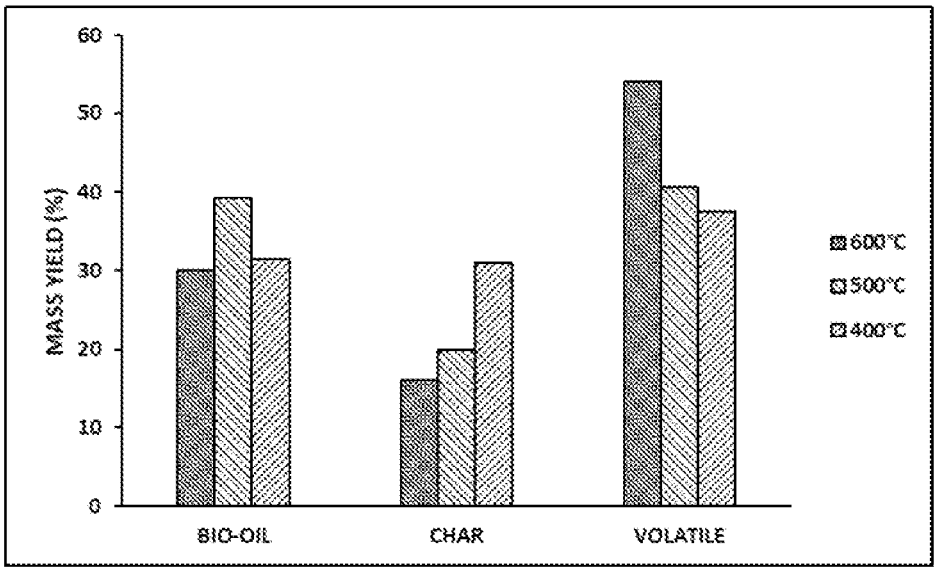
FIG. 2 is a bar chart of mass yield of pyrolysis products residual solid char, bio-syngas (referred to as "volatile" in the Figure) and bio-liquid (referred to as "bio-oil" in the Figure) during pyrolysis test work on biomass carried out at 400° C., 500° C., and 600° C.
Figure 3:
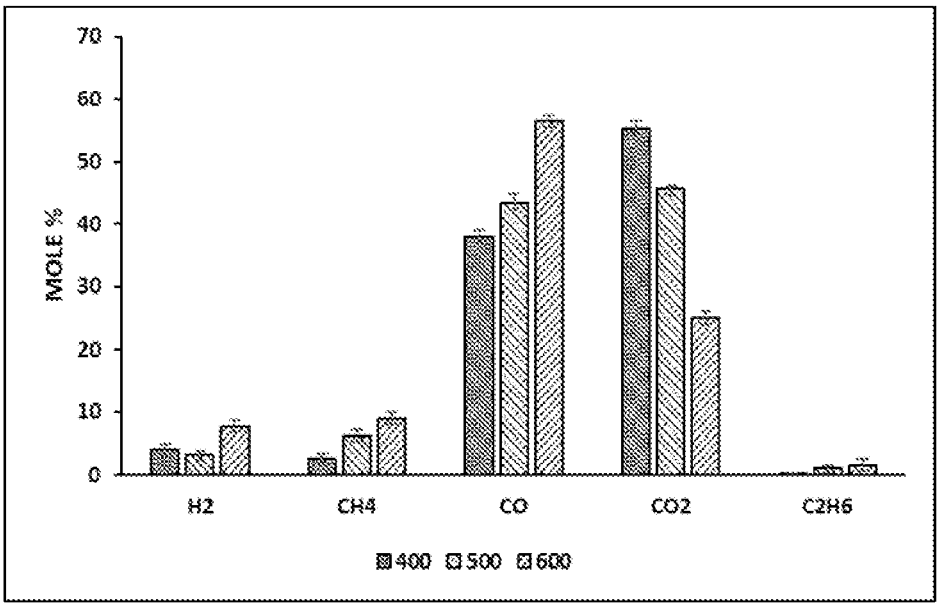
FIG. 3 is a bar chart of the compositions of bio-syngas produced during pyrolysis test work on biomass carried out at 400° C., 500° C., and 600° C.
Figure 4:
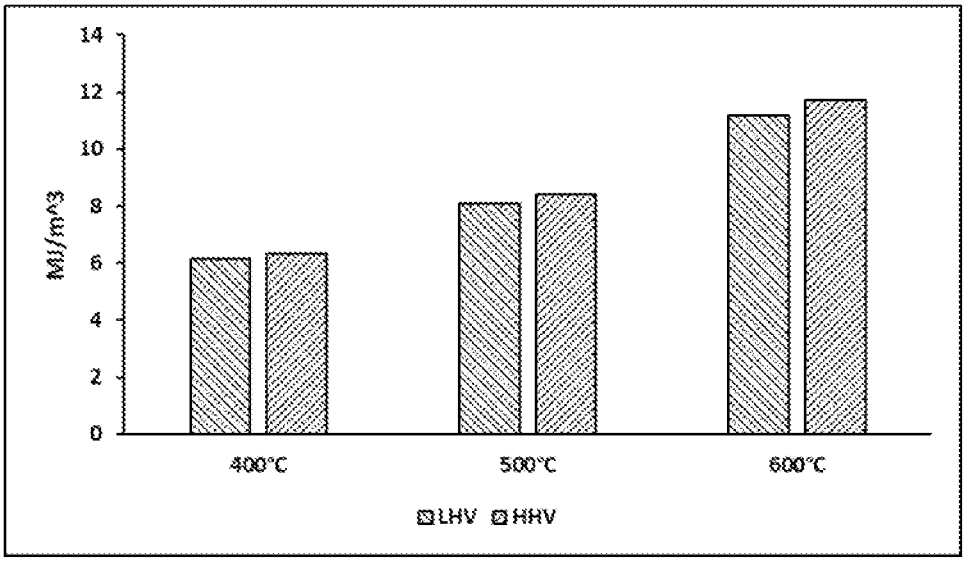
FIG. 4 is a bar chart of heating value (lower heating value ("LHV") and higher heating value ("HHV")) of bio-syngas produced during pyrolysis test work on biomass carried out at 400° C., 500° C., and 600° C.

- A thermogravimetric (TGA) analyser and a CHNSO analyser were used for elemental analysis.
- A gas chromatography-mass spectrometry (GC-MS) was for analysis of bio-oil, Experimental Results in FIGS. 2-4

The data presented in the Figures is the average of two experiments at each temperature, The gas data presented is the average of 5 individual gas chromatograph measurements for each experiment. The error is 2-5% during the measurements.

The results of the experimental work are summarized in FIGS. 2-4 and, as follows:

- It was observed that the bio-syngas composition produced in the reactors did not vary with feed rate.
- The compositions of the bio-syngas were a function of temperature.
- High temperature reduces solid yield and boosts bio-syngas yield.
- The heating value of the bio syngas can be increased if pyrolysis temperature is high (600° C. in this case).
- $CO_2$ can be reduced if the pyrolysis temperature is above 600° C.
- $H_2$, CO and $CH_4$ contents can be increased if biomass is pyrolyzed at higher temperatures, such as 600° C.

FIG. 5 Embodiment

Figure 5:
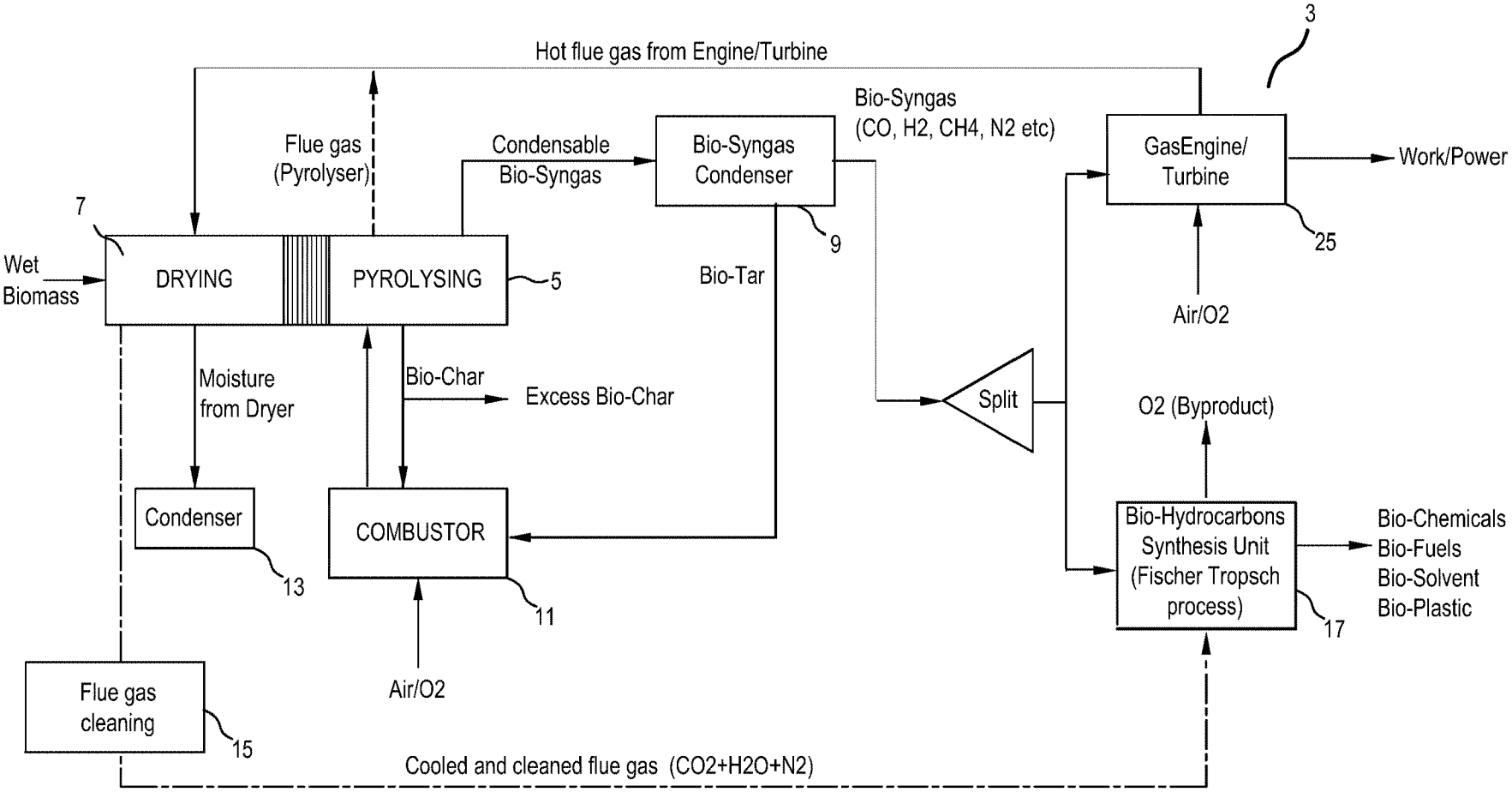
FIG. 5 is a flow sheet that summarises another, although not the only other, embodiment of the process and production plant of the present invention.

The embodiment of the process and production plant of the present invention shown in FIG. 5 for biomass conversion to fuel/power/chemicals is based on the data generated from the experimental work described above.

The flow sheet shown in FIG. 5 is a more specific flow sheet than the more general flow sheet shown in FIG. 1 and the same reference numerals are used in both Figures to describe the same operating units.

More particularly, the FIG. 5 flow sheet is a selection of unit operation options in the FIG. 1 flow sheet. The following description focuses on these selections.

In addition, in basic process terms, the two flow sheets have the same focus of selecting the operating conditions of the pyrolysis step to optimize/maximise non-condensable bio-syngas production compared to solid char production and to minimize bio-liquids (bio-tar in the Figure) production in the bio-syngas condenser 9 downstream of the pyrolysis unit 5. Based on the experimental work described above higher temperatures of >500° C., more typically >550° C., and more typically again >600° C. are required to increase the bio-syngas output for the pyrolysis unit 5.

With reference to FIG. 5, the bio-syngas from the bio-syngas condenser 9 is split onto two portions.

One portion is transferred to the gas engine/turbine 19 and is combusted with an air/$O_2$ mixture to generate work/power and a hot flue gas stream. The work/power is used as required in downstream applications. The hot flue gas stream is transferred to the drying unit 7 and used to dry feed biomass to a pre-determined moisture content for the pyrolysis unit 5.

The other portion of the bio-syngas is transferred to the bio-hydrocarbons synthesis unit 17, such as a Fischer Tropsch or other process unit, and produces (i) bio-chemicals, bio-fuels, bio-solvents, and bio-plastics and (ii) $O_2$, with the $O_2$ being beneficially used in the gas engine/turbine 25.

It is noted that the flue gas ($CO_2$, $H_2O$, and $N_2$) from the drying unit 7 is cleaned and then used beneficially in the bio-hydrocarbons synthesis unit 17. The bio-tar from the bio-syngas condenser 9 is used as an energy source in the combustor 11 for the pyrolysis unit 5.

The above embodiment is an effective and efficient embodiment of maximizing energy recovery from biomass.

FIG. 6 Embodiment

Figure 6:
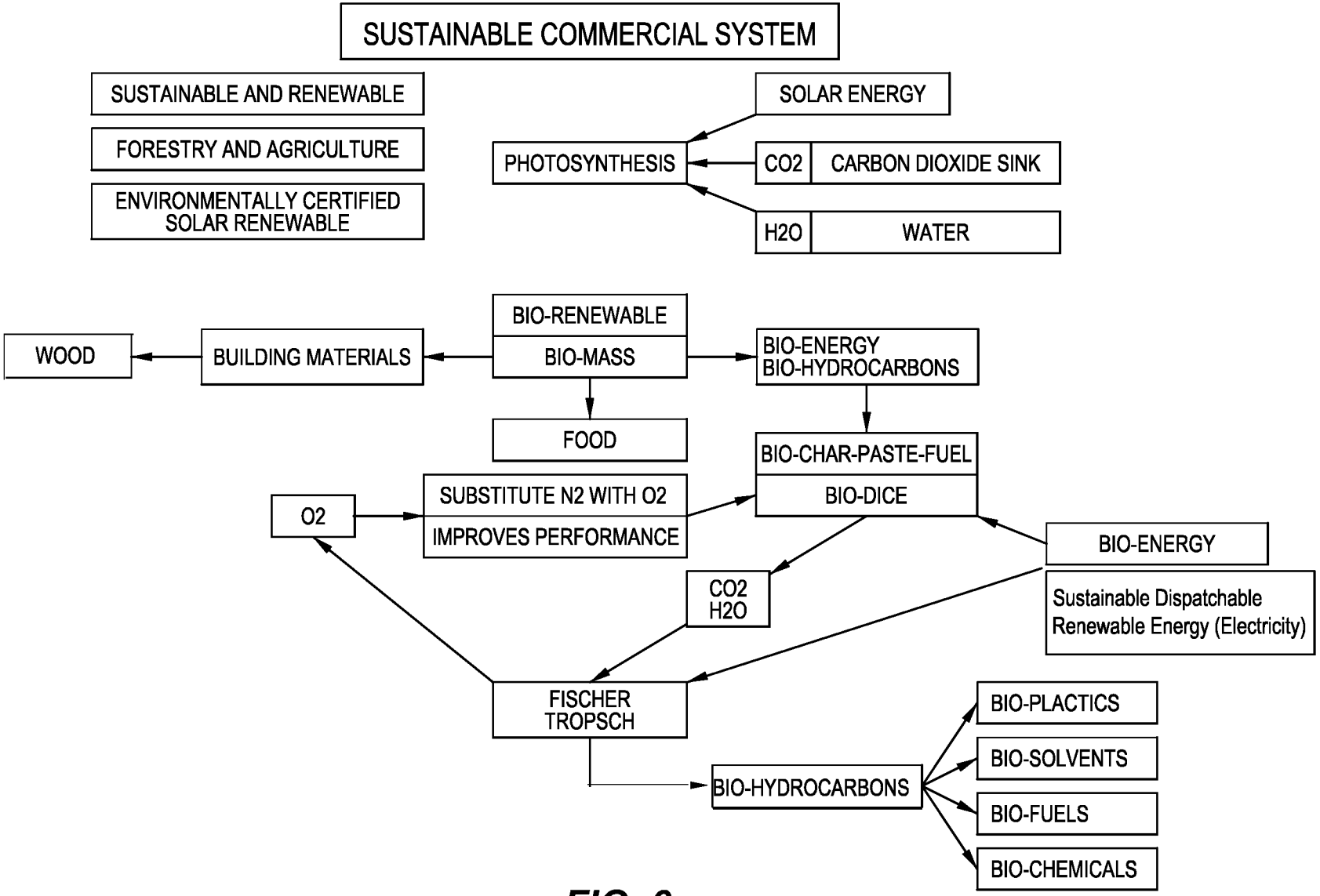
FIG. 6 is a drawing that illustrates an embodiment of an overall sustainable commercial system that includes the process and plant of the flow sheet of FIG. 1 and biomass production that feeds biomass into the flow sheet and downstream processing options.

FIG. 6 is a drawing that illustrates an embodiment of an overall sustainable commercial system that includes the process and plant of the flow sheets of FIG. 1 and FIG. 2 and biomass production that feeds biomass into the flow sheet and downstream processing options.

With reference to FIG. 6, the system includes the following elements:

(a) a source of biomass, such as forests, etc. that produces biomass—with the biomass production being renewable and sustainable and acting as a $CO_2$ sink;

(b) using the biomass as a feed input to the process and plant of the flow sheets of FIG. 1 and FIG. 2 and for other uses including building materials and food; and (c) using the bioenergy product, bio-hydrocarbon product, and the oxygen by-product from the process and plant of the flow sheets of FIG. 1 and FIG. 2 beneficially within the process/plant and for other end uses.

Many modifications may be made to the embodiment of the invention described above without departing form the spirit and scope of the invention.

By way of example, whilst the embodiment includes processing bio-syngas in a Fischer Tropsch process unit, the invention is not confined to this process unit and extends to the use of any suitable bio-hydrocarbons synthesis unit for processing the bio-syngas to produce end-sue products.

By way of further example, whilst the embodiments include a bio-syngas condenser unit 9, the invention is not so limited and extends to situations in which the bio-syngas produced in the pyrolysis unit 5 is used directly, i.e. without separating bio-syngas from the pyrolysis unit 5 into condensable and non-condensable constituent streams in the bio-syngas condenser unit 9, in downstream applications, for example as an energy source for a burner, such as a steam boiler. In this context, it is preferred that the operating conditions, such as temperature and residence time, for the pyrolysis unit 5 be selected to optimize the required gas composition for the direct end-use application.

The invention claimed is:

1. A process for producing products, including any one of bio-fuels, bio-chemicals, bio-solvents and bio-plastics, from biomass that comprises the following steps:

(a) drying a biomass feed material to a required moisture content, (b) pyrolysing the dried feed material at a selected temperature and decomposing the feed material and producing a bio-syngas and a solid char, selecting the operating conditions including temperature and residence time to optimize and/or maximize bio-syngas production compared to solid char production, with at least 80 wt. % of the output being bio-syngas, (c) condensing the bio-syngas from pyrolysis step (b) and removing condensable constituents from the bio-syngas and producing a condensed bio-liquid and a non-condensable bio-syngas; and (d) splitting the non-condensable bio-syngas from condensing step (c) into two portions, (e) combusting one portion of the non-condensable bio-syngas as a source of energy with an air/$O_2$ mixture and generating (i) work/power and (ii) a flue gas stream, (f) transferring the flue gas stream to the drying unit and using the flue gas stream to dry feed biomass, and (g) processing the other portion of the non-condensable bio-syngas in a bio-hydrocarbons synthesis process unit and producing one or more than one of bio-fuels, bio-chemicals, bio-solvents and bio-plastics.

2. The process defined in claim 1 wherein the selected temperature for the pyrolysis step (b) is >500° C.

3. The process defined in claim 1 wherein the selected temperature for the pyrolysis step (b) is >600° C.

4. The process defined in claim 1 wherein the bio-liquid includes bio-tar.

5. The process defined in claim 1 includes transferring $O_2$ from the bio-hydrocarbons synthesis process step (g) to the pyrolysis step (b) to substitute at least a part of the air that would otherwise be needed to combust an energy source to generate heat for the pyrolysis step thus, eliminating or minimising $N_2$.

6. The process defined in claim 1 includes enriching the bio-syngas by cracking bio-liquids produced in the process, thereby enriching bio-syngas with more $CH_4$, $C_2H_4$, and $C_2H_6$.

7. The process defined in claim 1 includes mixing (i) char from the pyrolysis step b), (ii) bio-liquids from the bio-syngas processing step (c) and (iii) optionally water and forming a paste product.

8. The process defined in claim 1 wherein the operating conditions for the pyrolysis step (b) are selected so that at least 85 wt. % of the output of the pyrolysis step (b) is bio-syngas.

9. The process defined in claim 1 wherein the operating conditions for the pyrolysis step (b) are selected so that at least 90 wt. % of the output of the pyrolysis step (b) is bio-syngas.

10. A plant for producing products, including any one of bio-fuels, bio-chemicals, bio-solvents and bio-plastics, from biomass that includes:

(a) a dryer unit for drying a biomass feed material to a required moisture content, (b) a pyrolyser unit for pyrolysing the dried feed material at a selected temperature and decomposing the feed material and producing a bio-syngas, wherein the pyrolyser unit includes a combustion unit for generating heat for pyrolysing the feed material, (c) a condenser for condensing bio-liquids from the bio-syngas from the pyrolysis unit and producing (i) condensed bio-liquids and (ii) a non-condensable bio-syngas;

(d) a splitter for splitting the non-condensable bio-syngas into two portions;

(e) a gas engine/turbine for generating work/power from one portion of the non-condensable bio-syngas; and (f) a bio-hydrocarbon synthesis unit for producing one or more than one bio-fuels, bio-chemicals, bio-solvents and bio-plastics, from the other portion of the non-condensable bio-syngas.

11. The plant defined in claim 10 wherein the pyrolyser unit is also adapted to produce char.

12. The plant defined in claim 10 wherein the combustion unit is adapted to operate with air, $O_2$ or $O_2$-enriched air.

13. The plant defined in claim 10 wherein the bio-hydrocarbon synthesis unit is configured to produce $O_2$.

14. The plant defined in claim 10 being configured to transfer $O_2$ produced in the bio-hydrocarbon synthesis unit to the combustion unit.

15. The plant defined in claim 10 wherein the selected temperature for the pyrolyser unit is a high temperature of >500° C.

16. The plant defined in claim 10 includes a paste product unit for producing the paste product from char from the pyrolyser unit, bio-liquids from the bio-syngas condenser unit, and optionally water.

* * * * *